US008310507B2

(12) United States Patent
Hiratsuka

(10) Patent No.: US 8,310,507 B2
(45) Date of Patent: Nov. 13, 2012

(54) DISPLAY DEVICE DRIVE CIRCUIT

(75) Inventor: Hitoshi Hiratsuka, Kanagawa (JP)

(73) Assignee: Renesas Electronics Corporation, Kawasaki-shi, Kanagawa (JP)

( * ) Notice: Subject to any disclaimer, the term of this patent is extended or adjusted under 35 U.S.C. 154(b) by 245 days.

(21) Appl. No.: 12/656,602

(22) Filed: Feb. 4, 2010

(65) Prior Publication Data

US 2010/0245399 A1 Sep. 30, 2010

(30) Foreign Application Priority Data

Mar. 25, 2009 (JP) ..... 2009-073533

(51) Int. Cl.
*G09G 5/10* (2006.01)

(52) U.S. Cl. ..... 345/690; 345/89; 345/100

(58) Field of Classification Search ..... 345/89, 345/94, 96, 100, 204, 211, 212, 690
See application file for complete search history.

(56) References Cited

U.S. PATENT DOCUMENTS

| | | | | |
|---|---|---|---|---|
| 2002/0000985 | A1* | 1/2002 | Hashimoto | 345/212 |
| 2003/0043129 | A1* | 3/2003 | Tazuke | 345/204 |
| 2004/0036670 | A1* | 2/2004 | Chung | 345/99 |
| 2004/0179027 | A1* | 9/2004 | Nakai et al. | 345/690 |
| 2006/0279505 | A1* | 12/2006 | Nagato et al. | 345/98 |
| 2007/0126722 | A1* | 6/2007 | Hashimoto | 345/204 |

FOREIGN PATENT DOCUMENTS

JP 2007-156235 6/2007

* cited by examiner

*Primary Examiner* — Amare Mengistu
*Assistant Examiner* — Koosha Sharifi-Tafreshi
(74) *Attorney, Agent, or Firm* — McGinn IP Law Group, PLLC

(57) ABSTRACT

Provided is a display device drive circuit capable of setting an optimum drive performance for each output amplifier without increasing the chip size. The display device drive circuit includes: at least two bias lines having different reference potentials; a selector that selects one of the bias lines based on a grayscale signal; and an output amplifier that is supplied with a reference potential of the one of the bias lines selected by the selector, generates a display signal, and supplies the display signal to a data line.

18 Claims, 3 Drawing Sheets

DISPLAY DEVICE DRIVE CIRCUIT

INCORPORATION BY REFERENCE

This application is based upon and claims the benefit of priority from Japanese patent application No. 2009-073533, filed on Mar. 25, 2009, the disclosure of which is incorporated herein in its entirety by reference.

BACKGROUND

1. Field of the Invention

The present invention relates to a drive circuit for a display device, and more particularly, to a display device drive circuit having a function for controlling the drive performance of an output amplifier.

2. Description of Related Art

A liquid crystal source driver for driving a liquid crystal display device includes a number of output amplifier circuits, and causes the output amplifier circuits to operate so as to drive a liquid crystal panel. In this case, the drive performance of the output amplifiers is adjusted depending on the type and usage of the liquid crystal panel. Meanwhile, in order to reduce heat generation of the display device and to reduce power consumption, a reduction in power consumption in an output amplifier unit is required.

Along with the recent increase in the screen size of liquid crystal display devices, the load capacitance of data lines of each liquid crystal display device is increasing. The liquid crystal source driver which outputs a display signal to a display output terminal of the liquid crystal display device is required to have a high drive performance when the potential of the display signal varies greatly. On the other hand, when the variation in potential of the display signal is small, the load of the data lines can be sufficiently driven with a low drive performance. Many liquid crystal source drivers are generally composed of output amplifier circuits having such features.

The magnitude of the variation in potential of the display signal varies depending on the display pattern of the liquid crystal display device. Thus, in the liquid crystal source driver, each of the output amplifiers has a function for setting a drive performance suitable for each display pattern.

FIG. 3 shows a circuit diagram of an output unit of a display device drive circuit (source driver) as a related art (see FIG. 15 of Japanese Unexamined Patent Application Publication No. 2007-156235). The circuit shown in FIG. 3 includes transistors 32*a* and 32*b*, which operate as constant current sources connected to an output transistor 31, and switch elements 33*a* and 33*b*.

Assuming herein that grayscale signals of the display device are 8-bit digital signals of "D7, D6, D5, D4, D3, D2, D1, and D0", D7 is defined as the most significant bit (MSB) and D0 is defined as the least significant bit (LSB). Additionally, the liquid crystal display device is assumed to be a normally black liquid crystal display device, since a large-scale liquid crystal display device is required to have a wide view angle and usually uses a normally black liquid crystal display device. In the normally black liquid crystal display device, the lowest transmittance (black display) is obtained when a voltage of 0 V is applied, and the highest transmittance (white display) is obtained when a voltage is applied. In this case, a grayscale signal of "00000000" is defined as indicating the black display, while a grayscale signal of "11111111" is defined as indicating the white display. The higher-order bits of the grayscale signal are used for the determination of a region of the white display or a region of the black display. In the circuit configuration of the output unit shown in FIG. 3, the most significant bit (D7) is used for the determination of a region of the white display or a region of the black display.

In the case where the most significant bit (D7) is used for the determination of the white display in which the variation in potential is large or the black display in which the variation in potential is small, at the time of the white display in which the most significant bit D7 is "1", the switch element 33*a* is turned on and the switch element 33*b* is turned off, thereby causing both the transistors 32*a* and 32*b* to operate as constant current sources. Meanwhile, at the time of the black display in which the most significant bit D7 is "0", the switch element 33*a* is turned off and the switch element 33*b* is turned on, thereby causing only the transistor 32*a* to operate as a constant current source. In this case, if the transistor 32*a* and the transistor 32*b* are equal in size, a constant current value obtained at the time of the black display is reduced to a half and the drive performance can be reduced. Moreover, this leads to a reduction in power consumption of the liquid crystal source driver without degrading the display quality.

SUMMARY

In the configuration disclosed in Japanese Unexamined Patent Application Publication No. 2007-156235, however, it is necessary to arrange the multiple constant current source elements 32*a* and 32*b* as in the circuit shown in FIG. 3 so as to adjust the drive performance of the output amplifiers. This leads to an increase in the circuit area. Furthermore, it is necessary to arrange a number of output amplifiers corresponding to the number of output terminals of the source driver of the display device. This causes a problem of an increase in the chip area of the source driver IC of the display device whose output is expected to increase in the future.

A first exemplary aspect of the present invention is a display device drive circuit including: at least two bias lines having different reference potentials; a selector that selects one of the bias lines based on a grayscale signal; and an output amplifier that is supplied with a reference potential of the one of the bias lines selected by the selector, generates a display signal, and supplies the display signal to a data line.

This configuration eliminates the need for arranging multiple constant current source elements for each output amplifier. Therefore, an optimum drive performance for each output amplifier can be set without increasing the chip size.

According to an exemplary aspect of the present invention, it is possible to provide a display device drive circuit capable of setting an optimum drive performance for each output amplifier without increasing the chip size.

BRIEF DESCRIPTION OF THE DRAWINGS

The above and other exemplary aspects, advantages and features will be more apparent from the following description of certain exemplary embodiments taken in conjunction with the accompanying drawings, in which.

DETAILED DESCRIPTION OF THE EXEMPLARY EMBODIMENTS

An exemplary embodiment of the present invention will be described below with reference to the accompanying drawings.

Figure 1:
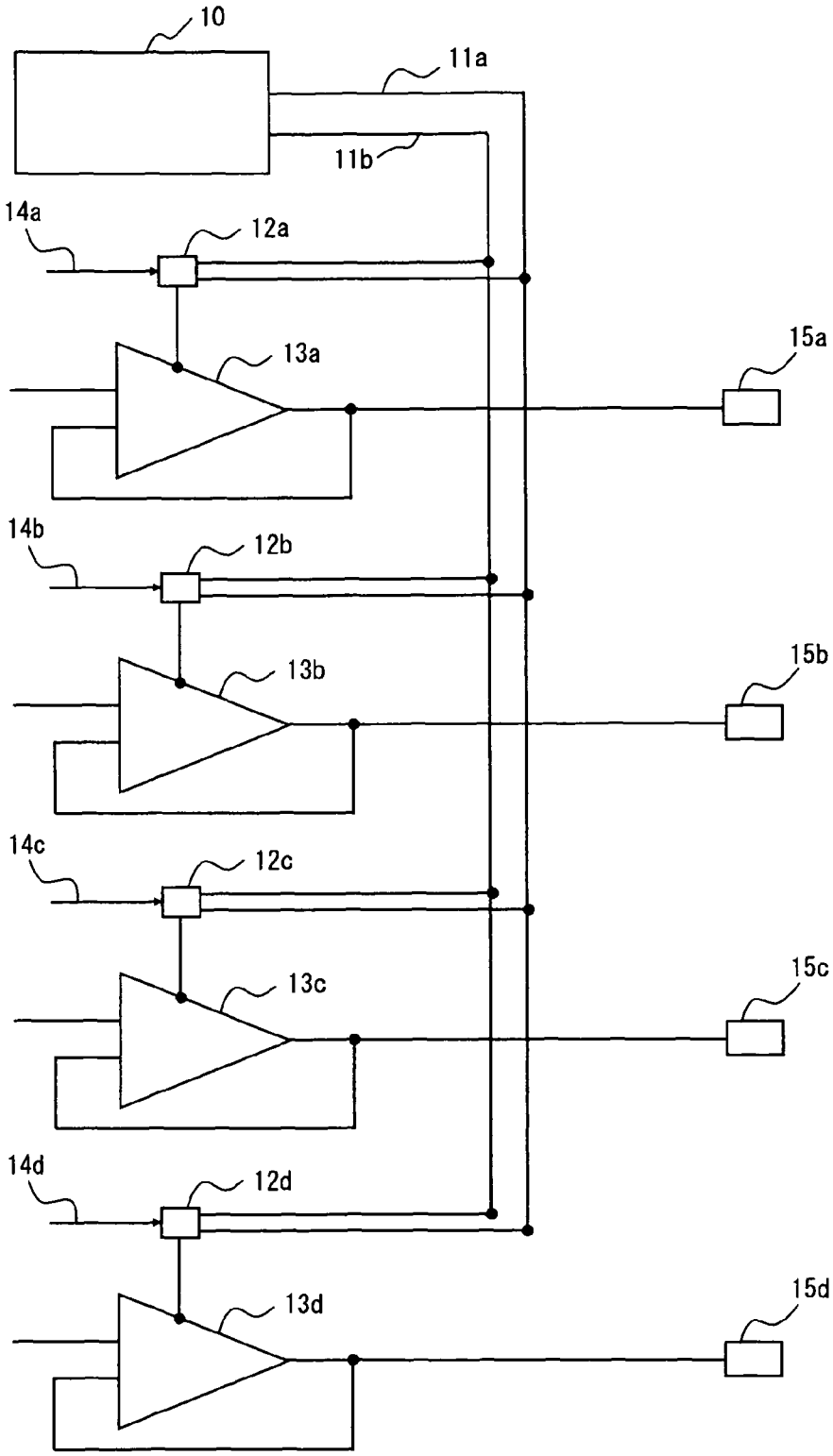
FIG. 1 is an explanatory circuit diagram showing a display device drive circuit (an output unit of a source driver) according to an exemplary embodiment of the present invention.

FIG. 1 is an explanatory diagram showing a display device drive circuit (an output unit of a source driver) according to this exemplary embodiment.

Referring to FIG. 1, a bias circuit 10 supplies different reference potentials to at least two bias lines 11*a* and 11*b*. Selectors 12*a*, 12*b*, 12*c*, and 12*d* are configured to select one of the bias lines 11*a* and 11*b* based on grayscale signals 14*a*, 14*b*, 14*c*, and 14*d*. Output amplifiers 13*a*, 13*b*, 13*c*, and 13*d* are supplied with the reference potential of the bias line selected by each selector. Each of the output amplifiers 13*a*, 13*b*, 13*c*, and 13*d* generates a display signal and supplies the generated display signal to a data line.

Herein, at least two bias lines are sufficient. As shown in FIG. 1, the at least two bias lines may include the bias line 11*a* for high drive (i.e., a state in which the drive performance is high) having a high bias potential and the bias line 11*b* for low drive (i.e., a state in which the drive performance is low) having a low bias potential. Alternatively, for example, three bias lines including the high potential bias line and the low potential bias line as well as a middle potential bias line may be used. The number of bias lines may be increased as needed. The bias lines 11*a* and 11*b* have no effect on the chip size, since the bias lines 11*a* and 11*b* can be arranged in an empty space within an existing wiring layer.

The selectors 12*a*, 12*b*, 12*c*, and 12*d* select one of the bias lines based on the grayscale signals 14*a*, 14*b*, 14*c*, and 14*d*. Herein, the grayscale signals are N-bit digital signals, for example, and each of the selectors may be configured to select one of the bias lines based on the most significant bit of the grayscale signals. Alternatively, each of the selectors may be configured to select one of the bias lines based on a number of higher-order bits (e.g., higher-order two bits) among the grayscale signals of the N-bit digital signals.

Figure 2:
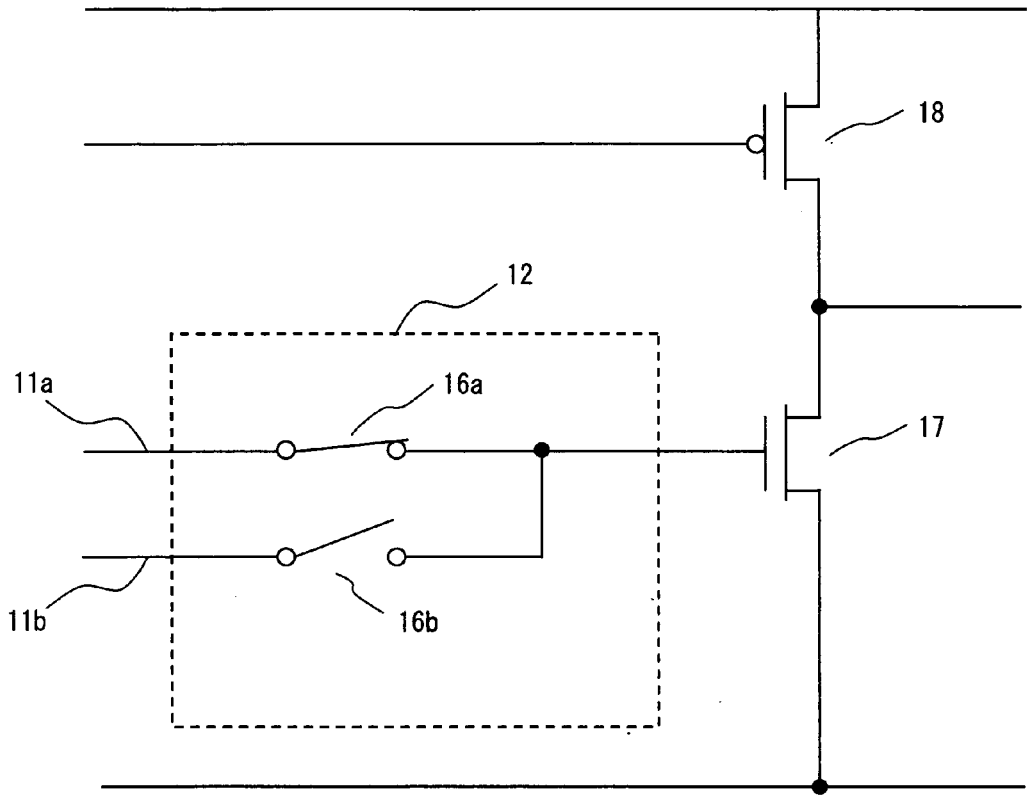
FIG. 2 is a circuit diagram showing an exemplary circuit configuration of a selector according to an exemplary embodiment of the present invention.
Figure 3:
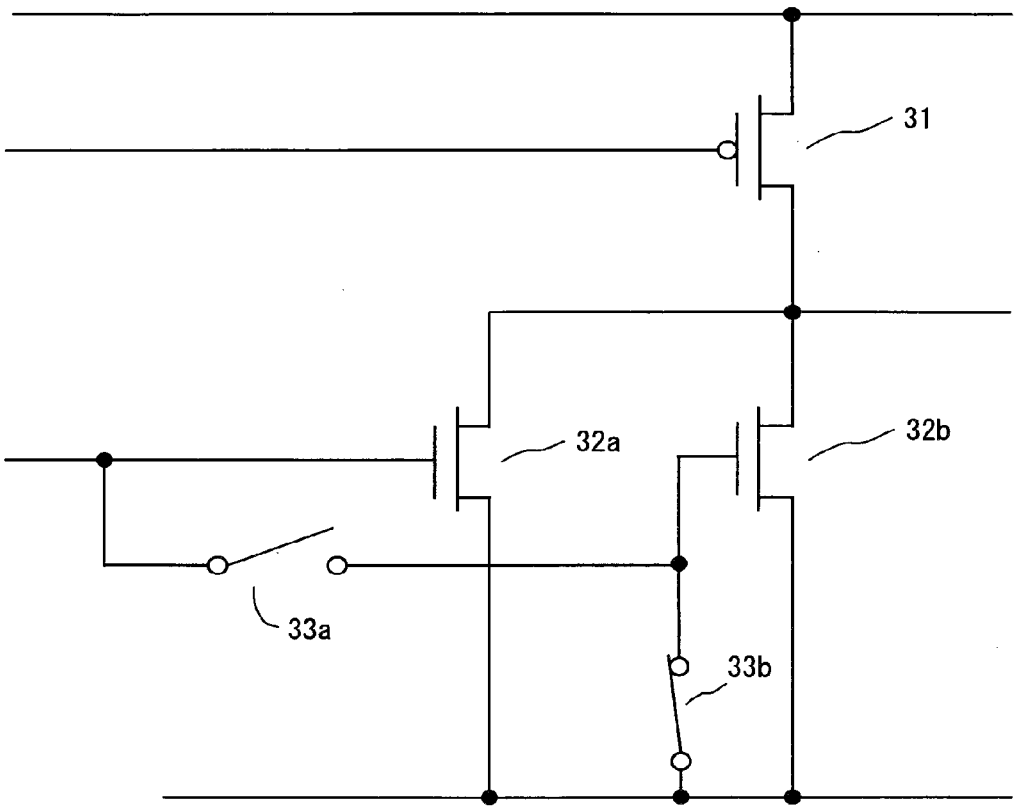
Fig. 3 (RELATED ART)
FIG. 3 is an explanatory circuit diagram showing an output unit of a display device drive circuit of the related art.

FIG. 2 shows an exemplary circuit configuration of a selector. Referring to FIG. 2, a selector 12 (corresponding to the selectors 12*a* to 12*d* shown in FIG. 1) is disposed between the bias lines 11*a* and 11*b* and the gate terminal of a transistor 17 that operates as a constant current source. The selector 12 includes switch elements 16*a* and 16*b* and causes one of the switch elements 16*a* and 16*b* to turn on, thereby making it possible to supply a bias potential to the gate terminal of the transistor 17 that operates as a constant current source. The constant current source element 17 is connected to an output transistor 18. The bias line 11*a* has a reference potential at which the output amplifiers exhibit a high drive performance, and the bias line 11*b* has a reference potential at which the output amplifiers exhibit a low drive performance.

Next, the output amplifiers 13*a*, 13*b*, 13*c*, and 13*d* will be described. The output amplifiers 13*a*, 13*b*, 13*c*, and 13*d* are voltage-follower-connected operational amplifier circuits. The positive phase input terminal of each of the output amplifiers is supplied with a grayscale voltage. In this case, the grayscale voltage can be generated in such a manner that the grayscale signal is subjected to DA conversion in a DA converter, for example. Each of the output amplifiers includes a constant current source element, and the constant current source element is supplied with a bias potential from the bias line selected by the selector. Each of the output amplifiers generates a display signal based on the grayscale voltage, and the generated display signal (i.e., the output of each of the output amplifiers) is supplied to data lines which are respectively connected to terminals 15*a*, 15*b*, 15*c*, and 15*d*.

Next, the operation of the display device drive circuit according to this exemplary embodiment will be described.

Assuming that the grayscale signals of the display device are 8-bit digital signals of "D7, D6, D5, D4, D3, D2, D1, and D0", for example, D7 is defined as the most significant bit and D0 is defined as the least significant bit.

In a normally black liquid crystal display device, for example, the lowest transmittance (black display) is obtained when a voltage of 0 V is applied, and the highest transmittance (white display) is obtained when a voltage is applied. In this case, a grayscale signal of "00000000" is defined as indicating the black display, while a grayscale signal of "11111111" is defined as indicating the white display.

At this time, the most significant bit (D7) is used for the determination of the white display in which the variation in potential is large, or the black display in which the variation in potential is small. In the case of the white display in which the most significant bit (D7) is "1", the switch element 16*a* is turned on and the switch element 16*b* is turned off, thereby setting the reference potential of the constant current source element 17 to the bias line 11*a* (high potential) to bring the output amplifier into a high drive state. That is, in the normally black liquid crystal display device, the constant current source element 17 and the high potential bias line 11*a* are connected to set the driving force of the output amplifier to a high level, since the variation in potential is large when the display is changed from a black display to a white display.

On the other hand, in the black display in which the most significant bit (D7) is "0", the switch element 16*a* is turned off and the switch element 16*b* is turned on, thereby setting the reference potential of the constant current source element 17 to the bias line 11*b* (low potential) to bring the output amplifier into a low drive state. That is, in the normally black liquid crystal display device, the constant current source element 17 and the low potential bias line 11*b* are connected to set the driving force of the output amplifier to a low level, since the variation in potential is small when the display is changed from a black display to a black display.

In this case, the most significant bit is used for the determination of the white display or the black display. The black display in which the most significant bit (D7) is "0" indicates the case where the grayscale signals range from "00000000" to "01111111". The white display in which the most significant bit (D7) is "1" indicates the case where the grayscale signals range from "10000000" to "11111111".

In this case, the grayscale signals are divided into two types for the black display and the white display. In the case of the black display, the driving force is set to a low level, while in the case of the white display, the driving force is set to a high level.

This operation makes it possible to reduce the drive performance of the output amplifiers at the time of the black display, without degrading the display quality. This leads to a reduction in power consumption of the display device drive circuit (liquid crystal source driver).

Next, a description is given of an operation to be performed in the case where the grayscale signal is changed from the white display state of the normally black liquid crystal display device.

When the grayscale signal is changed from the white display state to the black display state, that is, when a previous frame is a white display and a current frame is a black display, the grayscale signal varies greatly. As a result, the output amplifiers 13*a*, 13*b*, 13*c*, and 13*d* require a large driving force. The operation to be performed at this time is described below.

First, the value "1" of the most significant bit (D7) of the grayscale signal (white display) in the previous frame is compared with the value of the most significant bit (D7) of the grayscale signal in the current frame. Then, when the most significant bit changes from "1" to "0", that is, when the grayscale signal in the current frame is changed to the black display state, the switch element 16*a* shown in FIG. 2 is turned on and the switch element 16*b* shown in FIG. 2 is turned off. As a result, the gate of the constant current source element 17 is connected to the bias line 11*a* (high potential), thereby bringing the output amplifier into a high drive state.

Meanwhile, when the value "1" of the most significant bit (D7) of the grayscale signal (white display) in the previous frame is equal to the value of the most significant bit (D7) of the grayscale signal in the current frame, that is, when the grayscale signal is not changed and maintained in the white display state, the output amplifiers can be driven even in the low drive state. In this case, the switch element 16*a* shown in FIG. 2 is turned off and the switch element 16*b* shown in FIG. 2 is turned on, and the gate of the constant current source element 17 is connected to the bias line 11*b* (low potential), thereby bringing the output amplifier into a low drive state.

Note that in the case where the normally black liquid crystal display device is driven by a dot inversion driving method, the polarity may be changed when the display is changed from a white display to a white display. That is, when the previous frame is a positive white display, the current frame may be a negative white display. Further, when the previous frame is a negative white display, the current frame may be a positive white display. In this case, the output amplifiers 13*a*, 13*b*, 13*c*, and 13*d* require a large driving force, since the polarity is changed.

Accordingly, in such a case, a signal indicating that the polarity is to be changed is output as the grayscale signal to the selector 12. The selector 12 then causes the switch element 16*a* shown in FIG. 2 to turn on and the switch element 16*b* shown in FIG. 2 to turn off, thereby setting the reference potential of the constant current source element 17 to the bias line 11*a* (high potential) to bring the output amplifier into a high drive state.

Similarly, in the case where a normally white liquid crystal display device is driven by the dot inversion driving method, the polarity is changed when the previous frame is a positive black display and the current frame is a negative black display or when the previous frame is a negative black display and the current frame is a positive black display. Also in this case, a signal indicating that the polarity is to be changed is output as the grayscale signal to the selector, thereby bringing the output amplifiers into a high drive state.

The grayscale signals are N-bit digital signals, for example, and the description has been given of the example where the most significant bit of 8-bit grayscale signals is used for the determination of the black display or the white display in the above exemplary embodiment. Alternatively, the determination of the black display or the white display may be made using higher-order two bits of 8-bit grayscale signals, for example. In this case, the higher-order two bits of the grayscale signals can be expressed by four values "00", "01", "10", and "11". For this reason, the grayscale signals can be divided into four types.

At this time, four bias lines having different potentials may be provided to select a bias line based on the values of the higher-order two bits of the grayscale signals. Specifically, when the value of the higher-order two bits is "11", a bias line having the highest potential is selected, and when the value of the higher-order two bits is "10", a bias line having the second highest potential is selected. Further, when the value of the higher-order two bits is "01", a bias line having the third highest potential is selected, and when the value of the higher-order two bits is "00", a bias line having the lowest potential is selected.

Note that the number of bits of the grayscale signals for use in the discrimination of the black display or the white display may be increased as needed. The number of bias lines may also be increased depending on the number of divided grayscale signals.

Moreover, this exemplary embodiment of the present invention is applicable to a normally white liquid crystal display device. The normally white liquid crystal display device will be described in the same manner as in the case of the normally black display device. In the case of the normally white liquid crystal display device, the highest transmittance (white display) is obtained when a voltage of 0 V is applied, and the lowest transmittance (black display) is obtained when a voltage is applied. In this case, a grayscale signal of "00000000" is defined as indicating the white display, while a grayscale signal of "11111111" is defined as indicating the black display.

At this time, the most significant bit (D7) is used for the determination of the black display in which the variation in potential is large, or the white display in which the variation in potential is small. In the case of the black display in which the most significant bit (D7) is "1", the switch element 16*a* is turned on and the switch element 16*b* is turned off, thereby setting the reference potential of the constant current source element 17 to the bias line 11*a* (high potential) to bring the output amplifier into a high drive state. That is, in the normally white liquid crystal display device, the constant current source element 17 and the high potential bias line 11*a* are connected to set the driving force to a high level, since the variation in potential is large when the display is changed from a white display to a black display.

On the other hand, in the white display in which the most significant bit (D7) is "0", the switch element 16*a* is turned off and the switch element 16*b* is turned on, thereby setting the reference potential of the constant current source element 17 to the bias line 11*b* (low potential) to bring the output amplifier into a low drive state. That is, in the normally white liquid crystal display device, the constant current source element 17 and the low potential bias line 11*b* are connected to set the driving force to a low level, since the variation in potential is small when the display is changed from a white display to a white display.

According to an exemplary embodiment of the present invention, it is possible to provide a display device drive circuit capable of setting an optimum drive performance for each amplifier without increasing the chip size.

Furthermore, according to an exemplary embodiment of the present invention, the drive performance of each output amplifier can be reduced without degrading the display quality. This leads to a reduction in power consumption of the display device drive circuit.

While the invention has been described in terms of several exemplary embodiments, those skilled in the art will recognize that the invention can be practiced with various modifications within the spirit and scope of the appended claims and the invention is not limited to the examples described above.

Further, the scope of the claims is not limited by the exemplary embodiments described above.

Furthermore, it is noted that, Applicant's intent is to encompass equivalents of all claim elements, even if amended later during prosecution.

What is claimed is:

1. A display device drive circuit comprising:

at least two bias lines having different reference potentials;

a selector that selects one of the bias lines based on a grayscale signal; and an output amplifier that is supplied with a reference potential of the one of the bias lines selected by the selector, generates a display signal, and supplies the display signal to a data line, wherein:

the grayscale signal comprises an N-bit digital signal, and the selector selects one of the bias lines based on a most significant bit of the grayscale signal.

2. A display device drive circuit comprising:

at least two bias lines having different reference potentials;

a selector that selects one of the bias lines based on a grayscale signal; and an output amplifier that is supplied with a reference potential of the one of the bias lines selected by the selector, generates a display signal, and supplies the display signal to a data line, wherein:

the grayscale signal comprises an N-bit digital signal, and the selector selects one of the bias lines based on higher-order two bits of the grayscale signal.

3. The display device drive circuit according to claim 1, wherein the one of the bias lines selected by the selector supplies the reference potential to a constant current source element of the output amplifier.

4. The display device drive circuit according to claim 1, wherein:

the bias lines include a high potential bias line and a low potential bias line, and the selector selects the high potential bias line when the most significant bit of the grayscale signal is different from a most significant bit of a grayscale signal in a previous frame.

5. The display device drive circuit according to claim 1, wherein:

the bias lines include a high potential bias line and a low potential bias line, and the selector selects the low potential bias line when the most significant bit of the grayscale signal is equal to a most significant bit of a grayscale signal in a previous frame.

6. A display device drive circuit comprising:

at least two bias lines having different reference potentials;

a selector that selects one of the bias lines based on a grayscale signal; and an output amplifier that is supplied with a reference potential of the one of the bias lines selected by the selector, generates a display signal, and supplies the display signal to a data line, wherein, in a case where a display device driven by the display device drive circuit uses a dot inversion driving method for displaying the same color with different polarities, the selector receives, as the grayscale signal, a signal indicating that the polarity is to be changed, and selects one of the bias lines based on the signal indicating that the polarity is to be changed.

7. The display device drive circuit according to claim 6, wherein:

the bias lines include a high potential bias line and a low potential bias line, and in a case where the display device is a normally black liquid crystal display device, the selector selects the high potential bias line when a previous frame is a positive white display and a current frame is a negative white display or when the previous frame is a negative white display and the current frame is a positive white display.

8. The display device drive circuit according to claim 6, wherein:

the bias lines include a high potential bias line and a low potential bias line, and in a case where the display device is a normally white liquid crystal display device, the selector selects the high potential bias line when a previous frame is a positive black display and a current frame is a negative black display or when the previous frame is a negative black display and the current frame is a positive black display.

9. A display device drive circuit comprising:

at least two bias lines having different reference potentials;

a selector that selects one of the bias lines based on a grayscale signal; and an output amplifier that is supplied with a reference potential of the one of the bias lines selected by the selector, generates a display signal, and supplies the display signal to a data line, wherein the selector selects one of the bias lines based on a predetermined significant bit of the grayscale signal.

10. A display device drive circuit comprising:

at least two bias lines having different reference potentials;

a selector that selects one of the bias lines based on a grayscale signal; and an output amplifier that is supplied with a reference potential of the one of the bias lines selected by the selector, generates a display signal, and supplies the display signal to a data line, wherein the selector selects one of the bias lines based on higher-order bits of the grayscale signal.

11. The display device drive according to claim 10, wherein the selector selects one of the bias lines based on a portion of the grayscale signal.

12. The display device circuit according to claim 10, wherein:

the bias lines include a high potential bias line and a low potential bias line, and the selector selects the high potential bias line when a predetermined portion of the grayscale signal is different from a predetermined portion of a grayscale signal in a previous frame.

13. A display device drive circuit comprising:

at least two bias lines having different reference potentials;

a selector that selects one of the bias lines based on a grayscale signal; and an output amplifier that is supplied with a reference potential of the one of the bias lines selected by the selector, generates a display signal, and supplies the display signal to a data line, wherein:

the bias lines include a high potential bias line and a low potential bias line, and the selector selects the low potential bias line when the most significant bit of the grayscale signal is equal to a most significant bit of a grayscale signal in a previous frame.

14. A display device drive circuit comprising:

at least two bias lines having different reference potentials;

a selector that selects one of the bias lines based on a grayscale signal; and an output amplifier that is supplied with a reference potential of the one of the bias lines selected by the selector, generates a display signal, and supplies the display signal to a data line, wherein, when a dot inversion driving method for displaying a same color with different polarities is executed, the selector receives the grayscale signal including polarity information, and selects one of the bias lines based on the polarity information.

15. A display device drive circuit comprising:

at least two bias lines having different reference potentials;

a selector that selects one of the bias lines based on a grayscale signal; and an output amplifier that is supplied with a reference potential of the one of the bias lines selected by the selector, generates a display signal, and supplies the display signal to a data line, wherein:

the bias lines include a high potential bias line and a low potential bias line, and when a display device being driven is a normally black liquid crystal display device, the selector selects the high potential bias line when a previous frame is a positive white display and a current frame is a negative white display or when the previous frame is a negative white display and the current frame is a positive white display.

16. A display device drive circuit comprising:

at least two bias lines having different reference potentials;

a selector that selects one of the bias lines based on a grayscale signal; and an output amplifier that is supplied with a reference potential of the one of the bias lines selected by the selector, generates a display signal, and supplies the display signal to a data line, wherein:

the bias lines include a high potential bias line and a low potential bias line, and when a display device being driven is a normally white liquid crystal display device, the selector selects the high potential bias line when a previous frame is a positive black display and a current frame is a negative black display or when the previous frame is a negative black display and the current frame is a positive black display.

17. A display device drive circuit comprising:

at least two bias lines having different reference potentials;

a selector that selects one of the bias lines based on a change of a predetermined portion of a grayscale signal in a current frame from a previous frame; and an output amplifier that is supplied with a reference potential of the one of the bias lines selected by the selector, generates a display signal, and supplies the display signal to a data line, wherein:

the grayscale signal comprises an N-bit digital signal, and the selector automatically selects one of the bias lines based on a predetermined significant bit of the grayscale signal being automatically provided to the selector.

18. A display device drive circuit comprising:

at least two bias lines having different reference potentials;

a selector that selects one of the bias lines based on a change of a predetermined portion of a grayscale signal in a current frame from a previous frame; and an output amplifier that is supplied with a reference potential of the one of the bias lines selected by the selector, generates a display signal, and supplies the display signal to a data line, wherein the selector selects one of the bias lines based on higher-order bits of the grayscale signal and depending on a state of a display being driven.

* * * * *